United States Patent [19]

Wiklund

[11] Patent Number: 5,025,925

[45] Date of Patent: Jun. 25, 1991

[54] FLEXIBLE CONTAINER FOR FLUIDS

[75] Inventor: Christian Wiklund, Karleby, Finland

[73] Assignee: Oy Fluid-Bag Ab, Jakobstad, Finland

[21] Appl. No.: 573,167

[22] PCT Filed: Mar. 31, 1988

[86] PCT No.: PCT/FI88/00047

§ 371 Date: Oct. 12, 1990

§ 102(e) Date: Oct. 12, 1990

[87] PCT Pub. No.: WO89/09171

PCT Pub. Date: Oct. 5, 1989

[51] Int. Cl.[5] ..... B65D 19/00

[52] U.S. Cl. ..... 206/386; 206/597; 383/119

[58] Field of Search ..... 206/386, 597, 600; 383/41, 906, 121.1, 119, 104

[56] References Cited

U.S. PATENT DOCUMENTS 4,165,024 8/1979 Oswalt et al. ..... 222/105
4,927,037 5/1990 Boots ..... 220/1.5

FOREIGN PATENT DOCUMENTS 0338181 10/1989 European Pat. Off. ..... 383/41
8907561 8/1989 World Int. Prop. O. ..... 206/386
8911428 11/1989 World Int. Prop. O. ..... 206/597

*Primary Examiner*—Jimmy G. Foster
*Assistant Examiner*—Thomas P. Hilliard
*Attorney, Agent, or Firm*—Bell, Seltzer, Park & Gibson

[57] ABSTRACT

The invention relates to a flexible container for fluids, comprising an inner bag (1) of a thin material and an outer sack (2) of a durable fabric. The outer sack (2) is cylindrical and its mantle surface is provided with channels (4) for receiving support pillars (5) fastened to a wooden pallet (6). At deceleration during the transport of a full container, the upper ends of the forward support pillars exert great spot loads on the outer sack (2). Such loads can be avoided to a great extent if an outer and an inner side wall (8, 9) of the channels (4) are equally broad in the peripheral direction of the outer sack.

2 Claims, 1 Drawing Sheet

FIG. 1
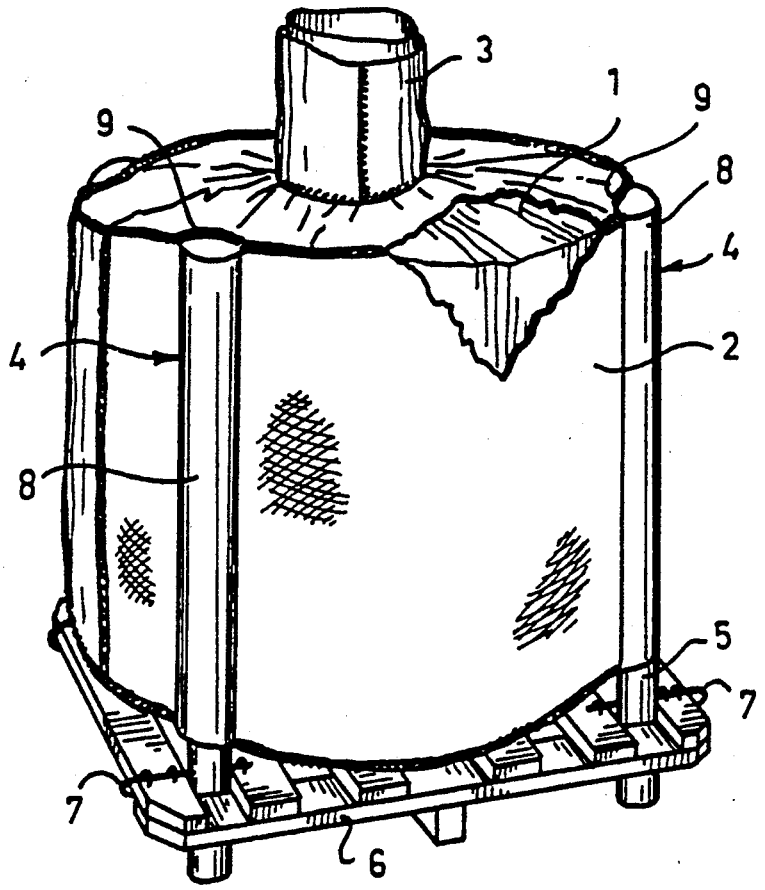
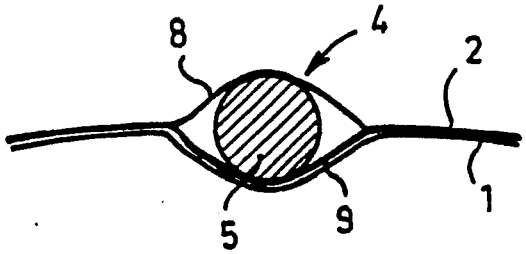
FIG. 2

FLEXIBLE CONTAINER FOR FLUIDS

The present invention relates to a flexible container for fluids, comprising a liquid-proof inner bag; a substantially cylindrical outer sack which surrounds the inner bag and the mantle surface of which is provided with channels for support pillars, said channels extending in parallel with the central line of the outer sack; and means for filling and emptying the container.

This type of containers known from the prior art are intended for the transport and storage of different kinds of fluids, such as liquids, viscous substances, and bulk goods. Such containers are usually manufactured in two sizes: five hundred litres and a thousand litres. The containers are disposable and they are transported to the user in folded position. Before filling, support pillars are inserted in the channels provided in the mantle surface of the outer sack, and the support pillars are fastened to a conventional pallet of wood, which makes the container easier to displace. The support pillars keep the container in upright position on the pallet.

The support pillars are mounted pivotably to the pallet by means of parallel metal shafts, which are secured to the pallet and extend through the support pillars. This way of mounting is used so as to reduce strains exerted on the support pillars on the pallet.

As mentioned above, the support pillars are positioned in channels provided in the mantle surface of the outer sack. The channels are formed by pockets open at the bottom and closed at the top. The pockets are formed by sewing elongated material strips onto the mantle surface of the outer sack, whereby the strips are sufficiently broad for the support pillars to be easily inserted into the space between the mantle of the outer sack and the material strip.

During transport, full containers are often exposed to variations in the transport velocity, whereby retardations in particular may be drastic. At retardation the fluid tends to continue its movement onwards more rapidly than the pallet, wherefore the support pillars swing onwards. The back portion of the sack is thereby lifted upwards along the backward support pillars, and the upper and lower surface of the sack takes an inclined position. The outer sack is thereby exposed to high strains especially at the upper ends of the forward support pillars, but to a certain extent also at the lower ends of the backward support pillars, which may result in breakage in the outer sack.

The object of the present invention is to provide a container in which the above-mentioned strains are considerably reduced as compared with containers known from the prior art. The container according to the invention is characterized in that an outer and an inner side wall of the channels have substantially the same dimension in the peripheral direction of the outer sack.

Channels formed in this way have the advantage that both side walls are strained when the container is filled, whereby they adhere to the support pillar. This results in great friction forces between the side walls of the channel and the support pillar so that strains caused by retardation will not focus on the upper end of the forward support pillars and on the lower end of the backward support pillars. Instead, they are distributed over the whole length of the support pillars. The disadvantageous spot load occurring in containers known from the prior art because the container is to some extent movable with respect to the support pillars is thereby avoided. As a result of the great friction forces between the support pillars and the channel wall, the container according to the invention is locked in place with respect to the support pillars, which prevents the back portion of the container from rising up on braking.

The channels according to the invention also have the advantage that they do not project from the mantle surface of the outer sack to such an extent as known channels. Therefore the channels are less exposed to shocks as prior channels.

According to a preferred embodiment, both channel walls are integral with the mantle of the outer sack. When the fabric is formed in this way known per se, the two seams in each channel are omitted, which naturally considerably simplifies the manufacture of the container.

A preferred embodiment of the container according to the invention will be described in more detail in the following with reference to the attached drawing, wherein FIG. 1 is a perspective view of a container according to the invention; and FIG. 2 illustrates a detail of the mantle surface of the outer sack in a horizontal section.

FIG. 1 shows a flexible container comprising a liquid-proof inner bag 1 of e.g. a thin polyethylene film; and a cylindrical outer sack 2 which surrounds the inner bag and is formed of e.g. a durable polypropylene fabric. The upper end face of the container is provided with a filling funnel 3 whereas the lower end face is provided with an emptying valve not shown.

The mantle surface of the outer sack is provided with four channels 4 which are parallel with the central axis of the sack and which are closed at the top and open at the bottom. A support pillar 5 of e.g. wood is inserted in each channel. Each support pillar is secured to a conventional pallet 6 of wood by means of a metal shaft 7. The shaft is fastened to the pallet and it extends through the support pillar so that the pillar is pivotable round the shaft 7 to some extent.

According to the invention the outer side wall 8 of the channels, i.e., the side wall on the outer side of the support pillar, and the inner side wall 9 on the inside of the support pillar have substantially the same dimension in the peripheral direction of the outer sack. This appears most clearly from FIG. 2. The dimension of the side wall in the peripheral direction of the outer sack refers to the width of the wall between lines along which the side walls adjoin to form a single wall. The mantle of the outer sack preferably consists of a fabric which is manufactured so that the mantle wall and the side walls 8, 9 are integral with each other.

The container is transported in the position shown in FIG. 1 except that the filling funnel 3 is closed. When decelerating a movement perpendicular to the shafts 7, the support pillars 5 are pivoted around the shafts and the container assumes a forwardly inclined position. Thereby the support pillars cause strains on the outer sack especially at the upper end of the forward pillars. Due to the high friction between the pillars 5 and the side walls 8, 9 of the channels, the load is, however, distributed over the whole length of the mantle surface so that the load is at its maximum at the upper end of the channels and at its minimum at the lower end. This distribution of the forces over a larger area naturally reduces the peak loads.

It is to be understood that in order that the channels would function as desired the outer side wall 8 must not be broader than the inner side wall 9. However, the inner side wall may be somewhat broader than the outer one, because the pressure of the fluid in the container presses the inner side wall against the support pillar 5.

I claim:

1. A flexible container for fluids, mounted on a pallet (6) and comprising a liquid-proof inner bag (1); a substantially cylindrical outer sack (2) which surrounds the inner bag and the mantle surface of which is provided with channels (4) for support pillars (5) pivotably secured to the pallet (6), said channels extending in parallel with the central axis of the outer sack; and means (3) for filling and emptying the container, characterized in that an outer and an inner side wall (8,9) of the channels (4) have substantially the same dimension in the peripheral direction of the outer sack (2).

2. A container according to claim 1, characterized in that both channel walls (8,9) are integral with the mantle of the outer sack (2).

* * * * *